US007513855B1

(12) United States Patent
Yeh

(10) Patent No.: US 7,513,855 B1
(45) Date of Patent: Apr. 7, 2009

(54) FOLDING EXERCISING MACHINE

(75) Inventor: Jonathan Yeh, Taipei Hsien (TW)

(73) Assignee: Proteus Sports Inc., Taipei Hsien (TW)

( * ) Notice: Subject to any disclaimer, the term of this patent is extended or adjusted under 35 U.S.C. 154(b) by 0 days.

(21) Appl. No.: 11/907,314

(22) Filed: Oct. 11, 2007

(51) Int. Cl.
*A63B 22/04* (2006.01)

(52) U.S. Cl. ..... 482/52; 482/51; 482/57

(58) Field of Classification Search ..... 482/51–53, 482/57–61, 71, 70; 74/594.3, 594.7
See application file for complete search history.

(56) References Cited

U.S. PATENT DOCUMENTS

| | | | | | |
|---|---|---|---|---|---|
| 5,004,224 | A * | 4/1991 | Wang | 482/53 |
| 5,586,472 | A * | 12/1996 | Lin | 74/594.1 |
| 5,749,811 | A * | 5/1998 | Wilson | 482/71 |
| 5,782,722 | A * | 7/1998 | Sands et al. | 482/52 |
| 5,868,648 | A * | 2/1999 | Coody et al. | 482/54 |
| 6,001,046 | A * | 12/1999 | Chang | 482/57 |
| 6,030,320 | A * | 2/2000 | Stearns et al. | 482/57 |
| 6,039,676 | A * | 3/2000 | Clive | 482/57 |
| 6,135,927 | A * | 10/2000 | Lo | 482/57 |
| 6,149,551 | A * | 11/2000 | Pyles et al. | 482/52 |
| 6,190,289 | B1 * | 2/2001 | Pyles et al. | 482/52 |
| 6,261,209 | B1 * | 7/2001 | Coody | 482/54 |
| 6,913,562 | B2 * | 7/2005 | Chen | 482/54 |
| 6,979,283 | B2 * | 12/2005 | Pan et al. | 482/54 |
| 7,004,887 | B2 * | 2/2006 | Pan et al. | 482/54 |
| 7,086,992 | B2 * | 8/2006 | Bowman et al. | 482/51 |
| 7,264,576 | B2 * | 9/2007 | Gerschefske et al. | 482/52 |
| 7,367,925 | B2 * | 5/2008 | Hsu | 482/52 |
| 2004/0005960 | A1 * | 1/2004 | Chang | 482/52 |
| 2004/0097339 | A1 * | 5/2004 | Moon | 482/52 |
| 2004/0162192 | A1 * | 8/2004 | Chen | 482/52 |
| 2005/0101445 | A1 * | 5/2005 | Chen | 482/52 |
| 2006/0046903 | A1 * | 3/2006 | Liao et al. | 482/52 |
| 2006/0172863 | A1 * | 8/2006 | Wang | 482/52 |
| 2006/0252604 | A1 * | 11/2006 | Moon | 482/52 |
| 2006/0287161 | A1 * | 12/2006 | Dalebout et al. | 482/52 |
| 2007/0129218 | A1 * | 6/2007 | Dalebout et al. | 482/52 |
| 2007/0238584 | A1 * | 10/2007 | Lee | 482/57 |

* cited by examiner

*Primary Examiner*—Loan H Thanh
*Assistant Examiner*—Daniel F Roland
(74) *Attorney, Agent, or Firm*—Bacon & Thomas, PLLC

(57) ABSTRACT

An folding exercising machine includes an upright with a bottom frame for positioning on a floor, two handlebars pivotally coupled to the upright at two sides, two pedal frames respectively pivoted to the bottom sides of the handlebars, each pedal frame having a bottom pin, a wheel module pivoted to the bottom frame of the upright and alternatively set between an operative position and a non-operative position, a lock screw provided at the bottom frame of the upright for locking the wheel module in the operative position, two first sockets respectively provided at two pedal cranks of a wheel of the wheel module for receiving the bottom pins of the pedal frames to hold the wheel module in the operative position, two second sockets provided at a transverse bar at the rear side of the wheel module for receiving the bottom pins of the pedal frames to hold the wheel module in the non-operative position, and a retaining member provided at the upright for locking the wheel module in the non-operative position.

6 Claims, 6 Drawing Sheets

FOLDING EXERCISING MACHINE

BACKGROUND OF THE INVENTION

1. Field of the Invention

The present invention relates to exercising machines and more particularly, to a folding exercising machine, which is collapsible.

2. Description of the Related Art

Due to limited living space and time, people have less space and time for exercises. Because physical exercise is an important activity that develops or maintains physical fitness and overall health, people cannot keep the body in a healthy condition without exercises. Making exercise a habit can prevent some diseases such as heart disease, cardiovascular disease and diabetes. Physical exercise is also correlated with mental health promotion and depression prevention. Therefore, many exercising machines are developed to help people make exercise a habit.

Conventional exercising machines are commonly heavy and not collapsible. These exercising machines require much installation space and delivery cost.

Therefore, it is desirable to provide an exercising machine, which is folding collapsible, and practical for home use.

SUMMARY OF THE INVENTION

The present invention has been accomplished under the circumstances in view. It is therefore one object of the present invention to provide an exercising machine, which is folding collapsible. It is another object of the present invention to provide a folding exercising machine, which allows for setting between the operative position and the non-operative position conveniently.

To achieve these and other objects of the present invention, the folding exercising machine comprises an upright, the upright comprising a bottom frame at a bottom side thereof for positioning on a floor, the bottom frame comprising a connecting structure, two horizontal pegs horizontally aligned at two sides and spaced above the bottom frame at a distance, and two connectors respectively pivotally coupled to the horizontal pegs; two handlebars respectively fastened to the connectors and turnable with the connectors about the horizontal pegs, the handlebars each having a bottom lug; two pedal frames respectively pivoted to the bottom lugs of the handlebars, the pedal frames each having a bottom pin downwardly extending from a bottom side thereof remote from the bottom lugs of the handlebars; and a wheel module pivoted to the bottom frame of the upright and alternatively set between an operative position and a non-operative position, the wheel module comprising a receiving structure disposed at a front side thereof and pivotally coupled to the connecting structure of the bottom frame of the upright, a wheel, two pedal cranks respectively connected to the wheel at two sides for rotating the wheel, the pedal cranks each having a rear end and a socket at the rear end for receiving the bottom pins of the pedal frames respectively when the wheel module is set in the operative position, and a transverse bar disposed at a rear side thereof for positioning on a floor.

DETAILED DESCRIPTION OF THE PREFERRED EMBODIMENT

Figure 1:
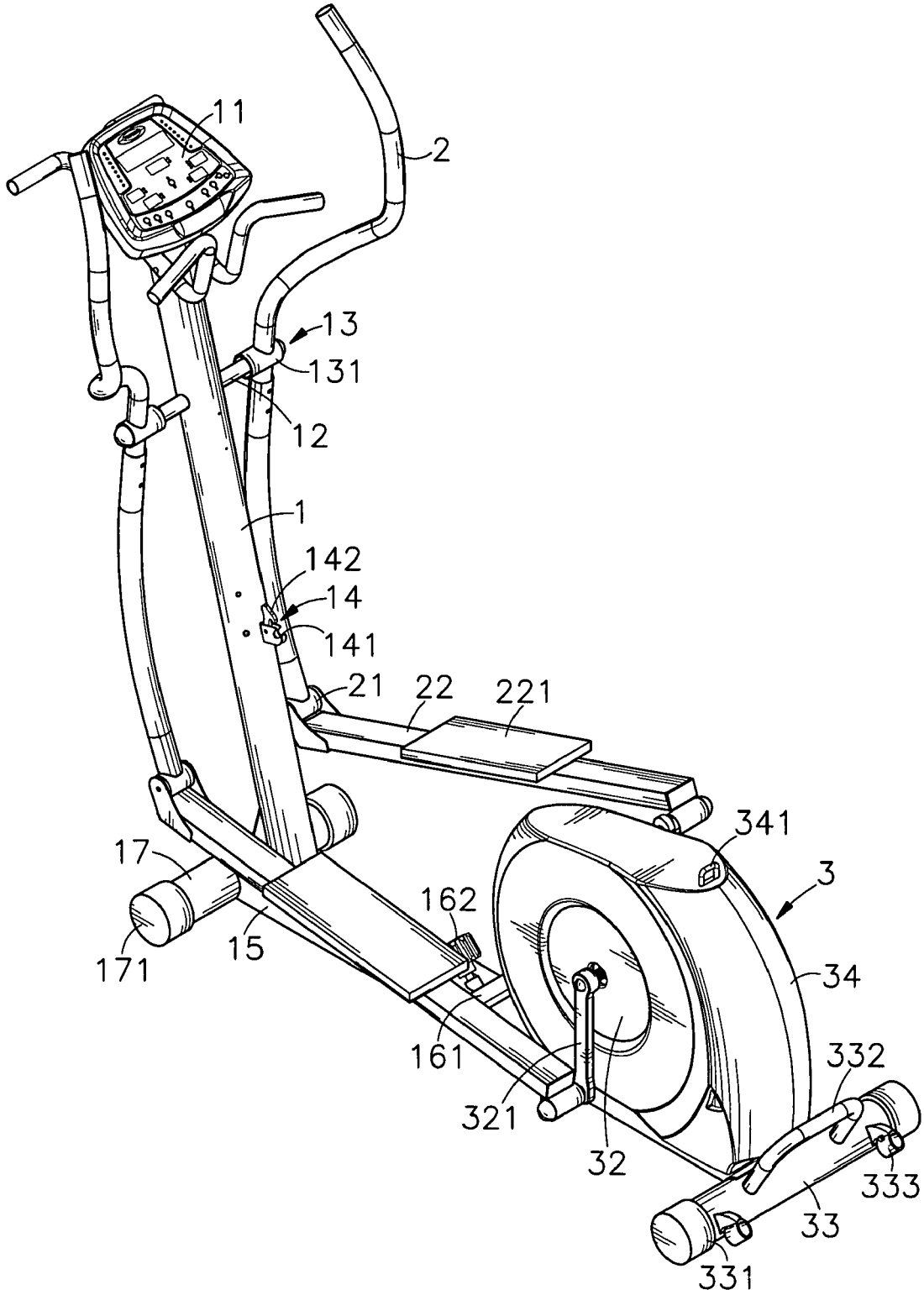
FIG. 1 is an elevational view of a folding exercising machine in accordance with the present invention.
Figure 2:
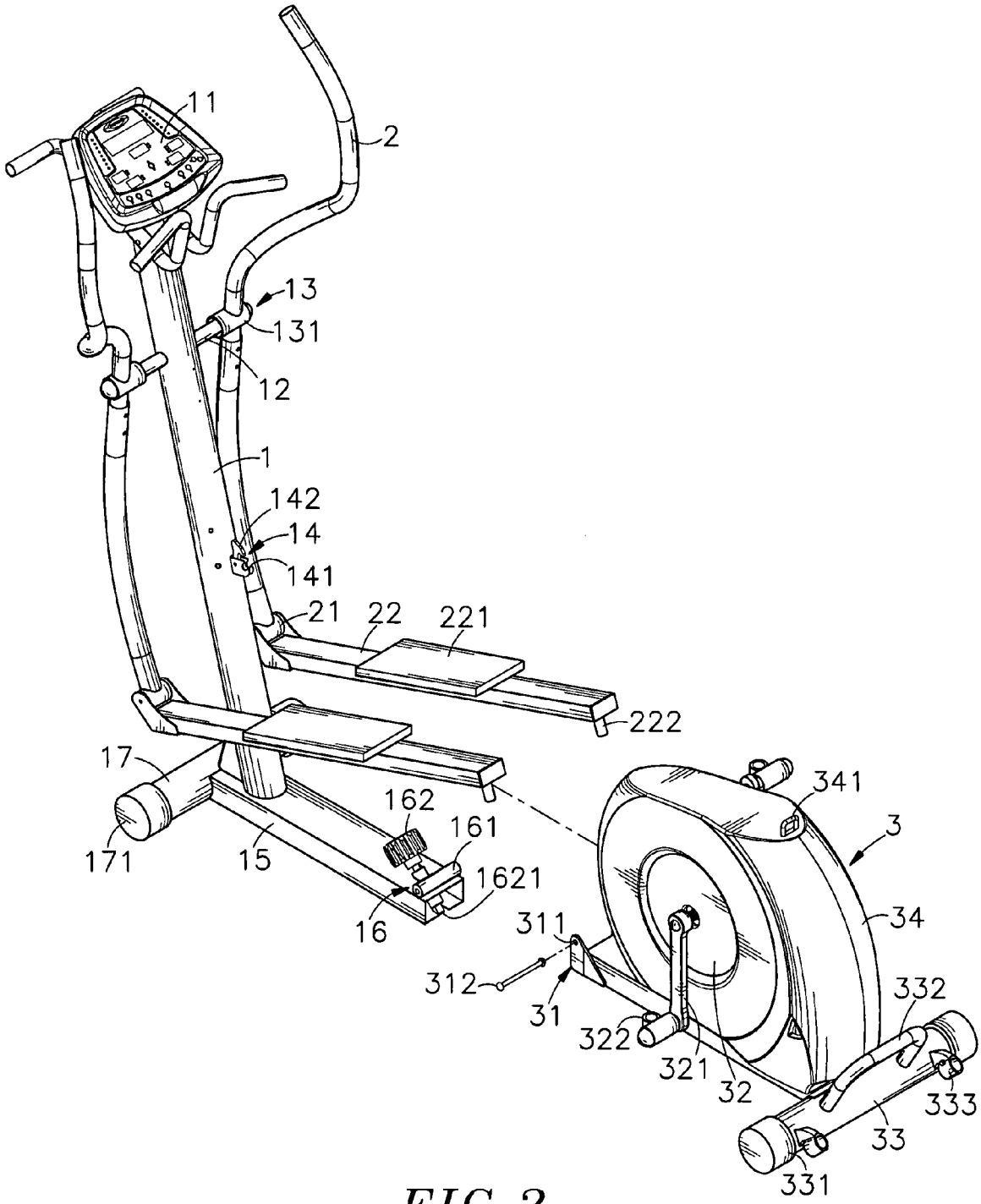
FIG. 2 is an exploded view of the folding exercising machine according to the present invention.
Figure 3:
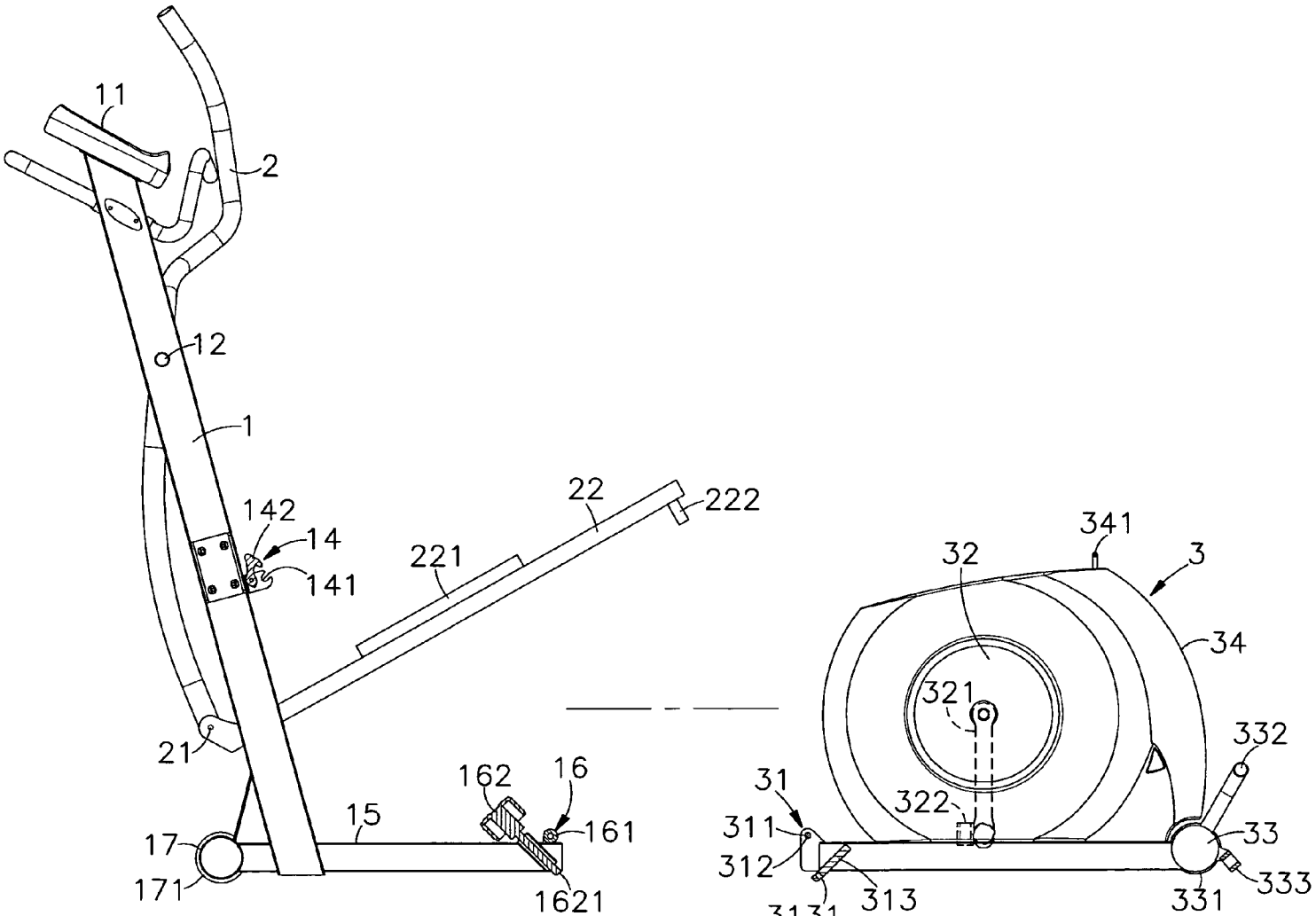
FIG. 3 is a side plain view of FIG. 2.
Figure 4:
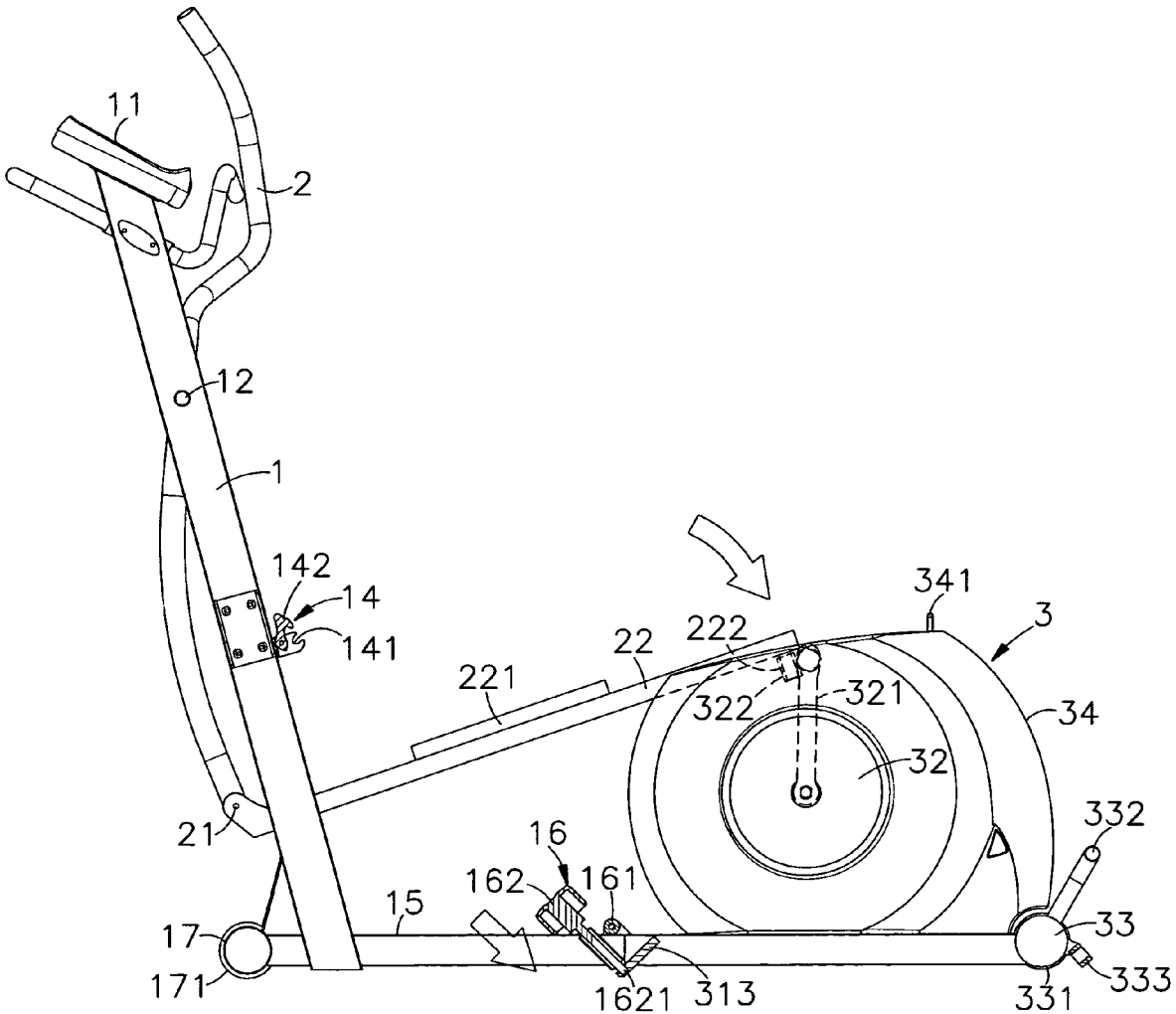
FIG. 4 is a side plain view of the present invention, showing the folding exercising machine assembled.

Referring to FIGS. 1~4, a folding exercising machine in accordance with the present invention is shown comprised of an upright 1, two handlebars 2 and a wheel module 3.

The upright 1 has a top side provided with a display panel 11, a bottom side mounted with a bottom frame 15, and two horizontal pegs 12 perpendicularly extended from the periphery at two opposite sides and horizontally aligned in line at a suitable elevation between the display panel 11 and the bottom frame 15. Two connectors 13 are provided for pivotally securing the handlebars 2 to the horizontal pegs 12. The connectors 13 each have an axle sleeve 131 respectively coupled to the horizontal pegs 12 for allowing rotation of the connectors 13 relative to the horizontal pegs 12. A retaining member 14 is provided at the periphery of the upright 1 below the elevation of the horizontal pegs 12. The retaining member 14 has a retaining groove 141, and is mounted with a swivel hook 142. A connecting structure 16 is provided at the rear side of the bottom frame 15. The connecting structure 16 comprises an axle housing 161 transversely disposed at the top edge of the rear side of the bottom frame 15, and a lock screw 162 disposed adjacent to the axle housing 161. The lock screw 162 has its threaded shank 1621 suspending in the bottom frame 15. A transverse bar 17 is fixedly connected to the front side of the bottom frame 15, having two anti-slip blocks 171 respectively disposed at the two distal ends.

The handlebars 2 are curved rod members each having a bottom lug 21. Two pedal frames 22 are respectively pivoted to the bottom lugs 21 of the handlebars 2. Each pedal frame 22 has a footplate 221 fixedly mounted on the top side on the middle, and a pin 222 downwardly extending from the bottom side of the rear end remote from the bottom lugs 21 of the handlebars 2.

The wheel module 3 comprises a receiving structure 31 at the front side, a wheel 32 disposed adjacent to the receiving structure 31, two pedal cranks 321 fastened to the wheel 32 at two sides for pedaling by a user to rotate the wheel 32, two first sockets 322 respectively fixedly provided at the free ends of the pedal cranks 321 for receiving the pins 222 of the pedal frames 22, a transverse bar 33 transversely disposed at the rear side, two anti-slip blocks 331 respectively disposed at the two distal ends of the transverse bar 33 for positive positioning on a floor surface, a substantially U-shaped carrying handle 332 fixedly provided at the transverse bar 33, two second sockets 333 fixedly provided at the transverse bar 33 for receiving the pins 222 of the pedal frames 22, and a wheel guard 34 for protecting the wheel 32. The wheel guard 34 has a retaining ring 341 disposed at the top side. The connecting structure 31 of the wheel module 3 comprises two pivot holes 311 aligned at two opposite lateral sides for the mounting of a pivot pin 312, a connecting plate 313 obliquely disposed below the elevation of the pivot holes 311, and a screw hole 3131 on the connecting plate 313.

During installation, the connectors 13 are respectively fastened to the handlebars 2, and then the axle sleeves 131 of the connectors 13 are respectively coupled to the horizontal pegs 12 of the upright 1, and then the connecting structure 16 of the bottom frame 15 is connected to the connecting structure 31 of the wheel module 3 by fastening the receiving pin 312 to the pivot holes 311 of the receiving structure 31 of the wheel module 3 and the axle housing 161 of the connecting structure 16 of the bottom frame 15, and then rotating the lock screw 162 to thread the threaded shank 1621 of the lock screw 162 into the screw hole 3131 of the connecting plate 313, and then the pins 222 of the pedal frames 22 are respectively plugged into the first sockets 322 of the wheel module 3.

The display panel 11 is adapted to indicate speed, mileage, calories consumed and etc., when the user is operating the folding exercising machine to make exercise. Through the display panel 11, the user knows his (her) current exercising status. Subject to the indication on the display panel 11, the user can adjust the exercising amount as desired. When operating the folding exercising machine, the user can hold the handlebars 2 with the hands and alternatively push and pull the handlebars 2 while stepping on the footplates 221. When the user is stepping on the footplates 221, the pedal cranks 321 are driven to rotate the wheel 32. Because the anti-slip blocks 171 and 331 support the folding exercising machine firmly on the floor, the folding exercising machine does not vibrate during operation.

Figure 5:
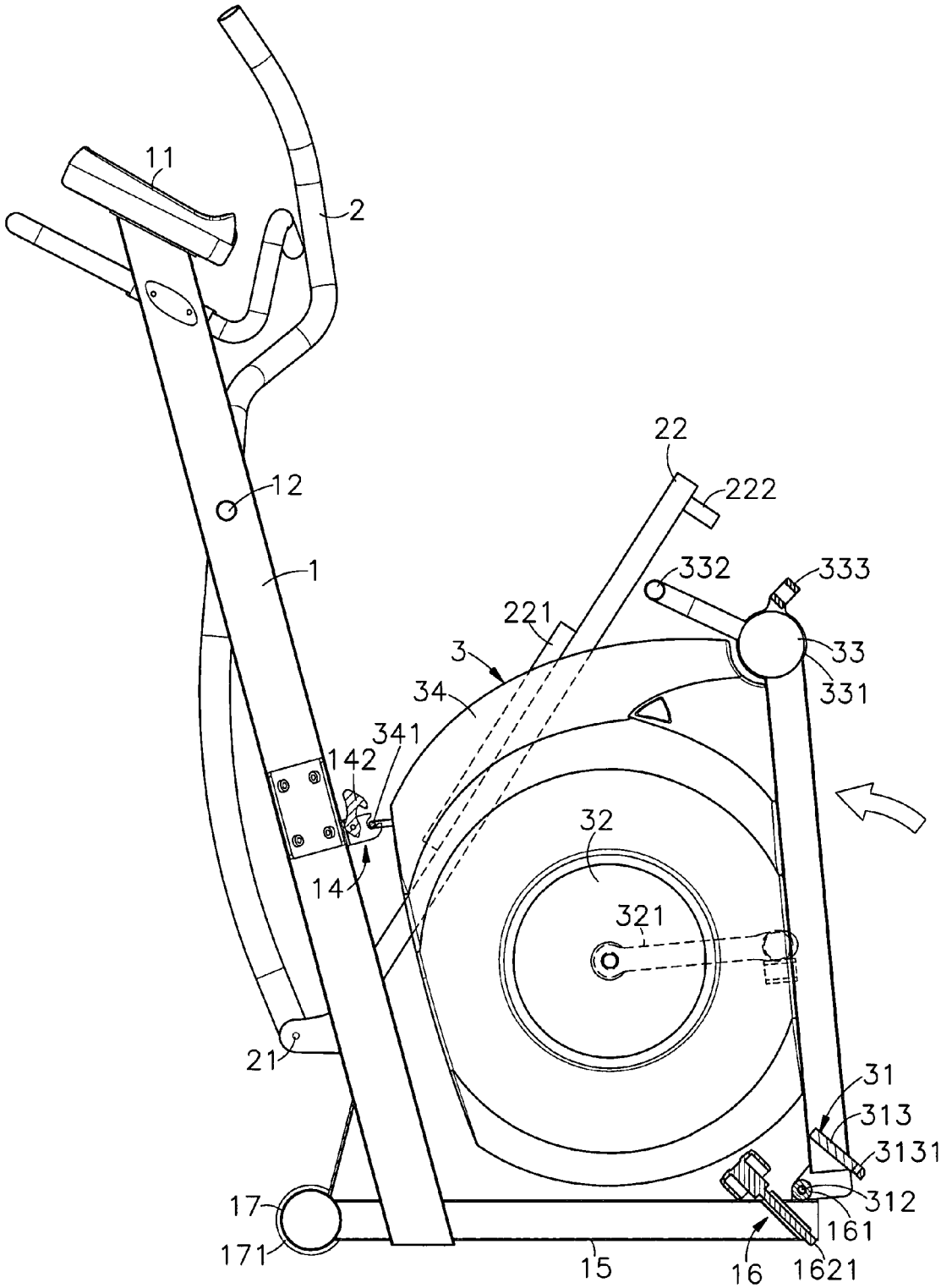
FIG. 5 is a schematic side view of the present invention, showing the wheel module unlocked from the lock screw and closely attached to the upright.
Figure 6:
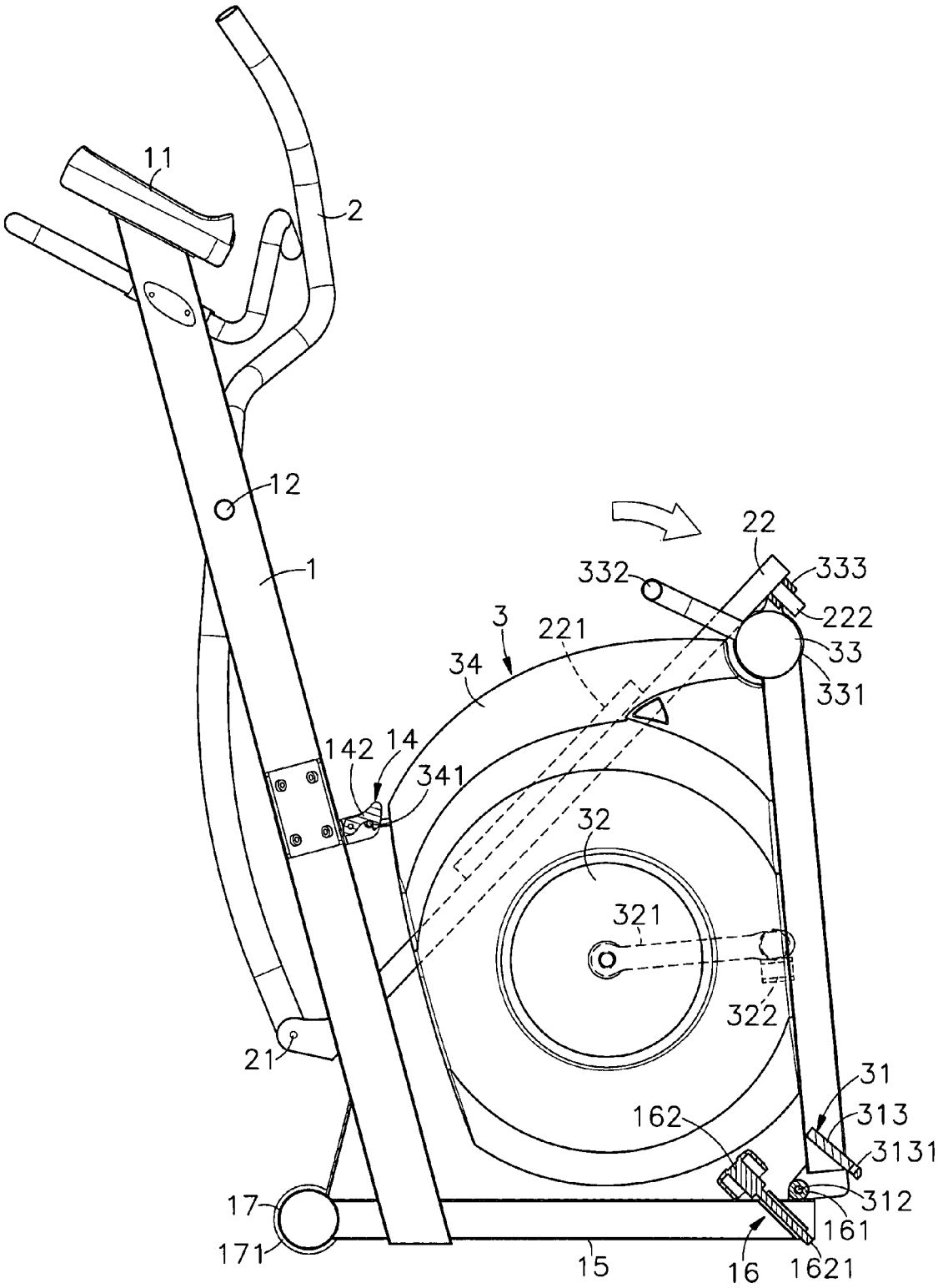
FIG. 6 corresponds to FIG. 5, showing the wheel module locked in the collapsed position.

When not in use, as shown in FIGS. 5 and 6, unfasten the lock screw 162 from the screw hole 3131 of the connecting plate 313, and lift the pedal frames 22 to disengage the pins 222 from the first sockets 322 of the wheel module 3, and then lift the carrying handle 332 to turn the wheel module 3 inwards toward the upright 1 and to force the retaining ring 341 into engagement with the retaining groove 141 of the retaining member 14, and then hook the swivel hook 142 on the retaining ring 341, and then turn the pedal frames 22 downwards to engage the pins 222 into the second sockets 333, and therefore the folding exercising machine is locked in a collapsed status.

As stated above, the invention provides a folding exercising machine, which has the following features and advantages:

By means of the receiving structure 31, the wheel module 3 is pivoted to the axle housing 161 of the connecting structure 16 and then locked in position by the lock screw 162. When unfastened the lock screw 162, the wheel module 3 is turned inwards and closely attached to the upright 1. When collapsed, the retaining ring 341 of the wheel guard 34 is locked to the retaining groove 141 of the retaining member 14 by the swivel hook 142, and the second sockets 333 of the wheel module 3 are fastened to the pins 222 of the pedal frames 22. By means of the retaining member 14, the connecting structure 16, and the pins 222 to a three-point positioning status, the folding exercising machine is held positively in the collapsed condition. When in the collapsed status, the wheel module 3 is disposed close to the upright 1 and the bottom frame 15. At this time, the wheel module 3 has a relatively lower center of gravity, and will not vibrate upon an external force.

Although a particular embodiment of the invention has been described in detail for purposes of illustration, various modifications and enhancements may be made without departing from the spirit and scope of the invention. Accordingly, the invention is not to be limited except as by the appended claims

The invention claimed is:

1. A folding exercising machine, comprising:

an upright, said upright comprising a bottom frame at a bottom side thereof for positioning on a floor, said bottom frame comprising a connecting structure, two horizontal pegs horizontally aligned at two sides and spaced above said bottom frame at a distance, and two connectors respectively pivotally coupled to said horizontal pegs;

two handlebars respectively fastened to said connectors and turnable with said connectors about horizontal pegs, said handlebars each having a bottom lug;

two pedal frames respectively pivoted to said bottom lugs of said handlebars, said pedal frames each having a bottom pin downwardly extending from a bottom side thereof remote from said bottom lugs of said handlebars; and a wheel module pivoted to said bottom frame of said upright and alternatively set between an operative position and a non-operative position, said wheel module comprising a receiving structure disposed at a front side thereof and pivotally coupled to said connecting structure of said bottom frame of said upright, a wheel, two pedal cranks respectively connected to said wheel at two sides for rotating said wheel, said pedal cranks each having a rear end and a socket at the rear end for receiving said bottom pins of said pedal frames respectively when said wheel module is set in said operative position, and a transverse bar disposed at a rear side thereof for positioning on a floor, wherein said wheel module comprises a wheel guard protecting said wheel, and a retaining ring fixedly provided at a top side of said wheel guard, and wherein said upright comprises a retaining member for fastening to said retaining ring of said wheel guard to hold said wheel module in said non-operative position.

2. The folding exercising machine as claimed in claim 1, wherein the retaining member of said upright comprises a retaining groove for receiving said retaining ring of said wheel guard, and a swivel hook for hooking on said retaining ring of said wheel guard to lock said retaining ring to said retaining groove.

3. The folding exercising machine as claimed in claim 1, wherein said transverse bar of said wheel module comprises two sockets for receiving said bottom pins of said pedal frames to secure said wheel module in said non-operative position.

4. The folding exercising machine as claimed in claim 1, wherein the connecting structure of said bottom frame of said upright comprises an axle housing coupled to said receiving structure of said wheel module, a lock screw, and a threaded shank for threading into said receiving structure of said wheel module to lock said wheel module in said operative position.

5. The folding exercising machine as claimed in claim 4, wherein said receiving structure of said wheel module comprises two pivot holes aligned at two opposite lateral sides and pivotally coupled to said axle housing of said connecting structure of said bottom frame of said upright with a pivot pin, and an oblique connecting plate, said oblique connecting plate having a screw hole for receiving said threaded shank.

6. The folding exercising machine as claimed in claim 1, wherein the transverse bar of said wheel module comprises two anti-slip blocks at two distal ends thereof, and a carrying handle disposed between said anti-slip blocks.

* * * * *